US011434738B1

(12) United States Patent
Han et al.

(10) Patent No.: US 11,434,738 B1
(45) Date of Patent: Sep. 6, 2022

(54) CYCLIC WELLBORE FRACTURING

(71) Applicants: Saudi Arabian Oil Company, Dhahran (SA); MetaRock Laboratories, Houston, TX (US); Rybkarock, Houston, TX (US)

(72) Inventors: Gang Han, Houston, TX (US); Munir Aldin, Houston, TX (US); Sau-Wai Wong, Houston, TX (US)

(73) Assignees: Saudi Arabian Oil Company, Dhahran (SA); MetaRock Laboratories, Houston, TX (US); Rybkarock, Houston, TX (US)

( * ) Notice: Subject to any disclaimer, the term of this patent is extended or adjusted under 35 U.S.C. 154(b) by 0 days.

(21) Appl. No.: 17/225,923

(22) Filed: Apr. 8, 2021

(51) Int. Cl.
*E21B 43/26* (2006.01)

(52) U.S. Cl.
CPC ..... *E21B 43/26* (2013.01)

(58) Field of Classification Search
CPC ..... E21B 43/26; E21B 43/2607; E21B 43/11; E21B 33/12
See application file for complete search history.

(56) References Cited

U.S. PATENT DOCUMENTS 2,915,122 A * 12/1959 Hulse ..... E21B 43/26 166/249
3,933,205 A 1/1976 Kiel
4,398,769 A * 8/1983 Jacoby ..... E21B 43/26 166/271
4,434,848 A 3/1984 Smith
7,559,373 B2 7/2009 Jackson et al.
2020/0378229 A1 * 12/2020 Kurison ..... E21B 43/14

OTHER PUBLICATIONS

Erarslan et al., "Understanding Rock Fatigue, Part I: Degradation of Rock Fracturing Resistance under Cyclic Loading," presented at the 2012 ISRM International Symposium, EUROCK, Stockholm, Sweden, May 28-30, 2012.
metarocklab.com (online), "Metarock Laboratories: Technology. Quality. Innovation," retrieved from URL <http://www.metarocklab.com/>, retrieved on Feb. 19, 2021, available on or before 2019, 4 pages.
Patel et al., "Laboratory Studies of Cyclic Injection Hydraulic Fracturing," proceedings of the 2016 SEG International Exposition and 87th Annual Meeting, SEG Technical Program Expanded Abstracts 2016, 3364-3368, 5 pages.
Sakhaee-Pour and Agrawal, "Predicting Breakdown Pressure and Breakdown Cycle in Cyclic Fracturing," SPE 191137/URTEC 2669677, Society of Petroleum Engineers (SPE), presented at the SPE/AAPG/SEG Unconventional Resources Technology Conference, Austin, Texas, Jul. 24-26, 2017, SPE Production & Operations, Nov. 2018, 33:4: 761-769, 9 pages.

(Continued)

*Primary Examiner* — James G Sayre
(74) *Attorney, Agent, or Firm* — Fish & Richardson P.C.

(57) ABSTRACT

A wellbore is formed within a rock formation. At least a portion of the wellbore is filled with pressurized fluid. A pressure of the pressurized fluid is cycled between 40% of an expected fracture pressure of the rock formation and 85% of the expected fracture pressure of the rock formation. The rock formation is fractured responsive to the cycling pressure.

20 Claims, 3 Drawing Sheets

(56) References Cited

OTHER PUBLICATIONS

Tiancheng et al., "Laboratory Study of Hydraulic Fracturing in Cyclic Injection," ARMA 18-047, American Rock Mechanics Association (ARMA), presented at the 52nd US Rock Mechanics/Geomechanics Symposium, Seattle, Washington, USA, Jun. 17-20, 2018, 7 pages.

Zhang et al., "Laboratory Evaluation of Induced Seismicity Reduction and Permeability Enhancement Effects of Cyclic Hydraulic Fracturing," ARMA 17-757, American Rock Mechanics Association (ARMA), presented at the 51th US Rock Mechanics/Geomechanics Symposium, San Francisco, California, Jun. 25-28, 2017, 10 pages.

* cited by examiner

CYCLIC WELLBORE FRACTURING

TECHNICAL FIELD

This disclosure relates to wellbore fracturing.

BACKGROUND

In hydrocarbon production, production wellbores are often fractured to increase production rates. Fracturing a wellbore involves pumping high pressure fluid (for example, over 10,000 pounds per square inch) into the wellbore in order to over pressure the wellbore. This overpressure event causes the geologic formation in which the wellbore is formed to exceed a near-wellbore stress and rock strength and result in hydraulic fractures. Sometimes, additives, such as "proppants" are added to the high pressure fluid to "prop" open the fractures.

SUMMARY

This disclosure describes technologies relating to cyclic wellbore fracturing.

An example implementation of the subject matter described within this disclosure is a method with the following features. A wellbore is formed within a rock formation. At least a portion of the wellbore is filled with pressurized fluid. A pressure of the pressurized fluid is cycled between 40% of an expected fracture pressure of the rock formation and 85% of the expected fracture pressure of the rock formation. The rock formation is fractured responsive to the cycling pressure.

Aspects of the example method, which can be combined with the example method alone or with other aspects, include the following. Cycling the pressure includes flowing, by a pump, the pressurized fluid until a first target pressure is reached, and after the first target pressure is reached, releasing the pressurized fluid until a second target pressure being less than the first target pressure, is reached.

Aspects of the example method, which can be combined with the example method alone or with other aspects, include the following. Cycling the pressure includes increasing the pressure to 50% of the expected fracture pressure of the rock formation, and decreasing the pressure to 40% of the expected fracture pressure of the rock formation.

Aspects of the example method, which can be combined with the example method alone or with other aspects, include the following. Cycling the pressure includes increasing the pressure from 40% of the expected fracture pressure of the rock formation to 60% of the expected fracture pressure of the rock formation, and decreasing the pressure to 40% of the expected fracture pressure of the rock formation from 60% of the expected fracture pressure of the rock formation.

Aspects of the example method, which can be combined with the example method alone or with other aspects, include the following. Cycling the pressure includes increasing the pressure from 40% of the expected fracture pressure of the rock formation to 70% of the expected fracture pressure of the rock formation, and decreasing the pressure to 40% of the expected fracture pressure of the rock formation from 70% of the expected fracture pressure of the rock formation.

Aspects of the example method, which can be combined with the example method alone or with other aspects, include the following. Cycling the pressure includes increasing the pressure from 40% of the expected fracture pressure of the rock formation to 80% of the expected fracture pressure of the rock formation, and decreasing the pressure to 40% of the expected fracture pressure of the rock formation from 80% of the expected fracture pressure of the rock formation.

Aspects of the example method, which can be combined with the example method alone or with other aspects, include the following. Cycling the pressure includes increasing the pressure from 40% of the expected fracture pressure of the rock formation to 85% of the expected fracture pressure of the rock formation, and decreasing the pressure to 40% of the expected fracture pressure of the rock formation from 85% of the expected fracture pressure of the rock formation.

An example implementation of the subject matter described within this disclosure is a method of fracturing a wellbore. The method includes the following features. At least a portion of a wellbore, formed within a rock formation, is filled with pressurized fluid. A pressure of the pressurized fluid is cycled such that the pressure does not exceed 85% of an expected fracture pressure of the rock formation. The rock formation is fractured responsive to the cycling pressure.

Aspects of the example wellbore fracturing method, which can be combined with the example wellbore fracturing method alone or with other aspects, include the following. Cycling the pressure includes flowing, by a pump, the pressurized fluid until a first target pressure is reached, and after the first target pressure is reached, releasing the pressurized fluid until a second target pressure being less than the first target pressure, is reached.

Aspects of the example wellbore fracturing method, which can be combined with the example wellbore fracturing method alone or with other aspects, include the following. The pressure is at least 40% of the expected fracture pressure for an entire duration of pressure cycling.

Aspects of the example wellbore fracturing method, which can be combined with the example wellbore fracturing method alone or with other aspects, include the following. Cycling the pressure includes increasing the pressure to 50% of the expected fracture pressure of the rock formation, and decreasing the pressure to 40% of the expected fracture pressure of the rock formation.

Aspects of the example wellbore fracturing method, which can be combined with the example wellbore fracturing method alone or with other aspects, include the following. Cycling the pressure includes increasing the pressure to 60% of the expected fracture pressure of the rock formation, and decreasing the pressure to 40% of the expected fracture pressure of the rock formation from 60% of the expected fracture pressure of the rock formation.

Aspects of the example wellbore fracturing method, which can be combined with the example wellbore fracturing method alone or with other aspects, include the following. Cycling the pressure includes increasing the pressure to 70% of the expected fracture pressure of the rock formation, and decreasing the pressure to 40% of the expected fracture pressure of the rock formation from 70% of the expected fracture pressure of the rock formation.

Aspects of the example wellbore fracturing method, which can be combined with the example wellbore fracturing method alone or with other aspects, include the following. Cycling the pressure includes increasing the pressure to 80% of the expected fracture pressure of the rock formation, and decreasing the pressure to 40% of the expected fracture pressure of the rock formation from 80% of the expected fracture pressure of the rock formation.

Aspects of the example wellbore fracturing method, which can be combined with the example wellbore fracturing method alone or with other aspects, include the following. Cycling the pressure includes increasing the pressure to 85% of the expected fracture pressure of the rock formation, and decreasing the pressure to 40% of the expected fracture pressure of the rock formation from 85% of the expected fracture pressure of the rock formation.

An example implementation of the subject matter described within this disclosure is a method of fracturing a rock formation. The method includes the following features. At least a portion of a wellbore, formed within a rock formation, is filled with pressurized fluid. A pressure of the pressurized fluid is cycled such that the pressure is sustained at least at 40% of an expected fracture pressure of the rock formation. The rock formation is fractured responsive to the cycling pressure.

Aspects of the example wellbore fracturing method, which can be combined with the example wellbore fracturing method alone or with other aspects, include the following. Cycling the pressure includes flowing, by a pump, the pressurized fluid until a first target pressure is reached. After the first target pressure is reached, the pressurized fluid is released until a second target pressure, less than the first target pressure, is reached.

Aspects of the example wellbore fracturing method, which can be combined with the example wellbore fracturing method alone or with other aspects, include the following. The pressure does not exceed 85% of the expected fracture pressure for an entire duration of pressure cycling.

Aspects of the example wellbore fracturing method, which can be combined with the example wellbore fracturing method alone or with other aspects, include the following. Cycling the pressure includes increasing the pressure to 50% of the expected fracture pressure of the rock formation, and decreasing the pressure to 40% of the expected fracture pressure of the rock formation.

Aspects of the example wellbore fracturing method, which can be combined with the example wellbore fracturing method alone or with other aspects, include the following. Cycling the pressure includes increasing the pressure to 60% of the expected fracture pressure of the rock formation, and decreasing the pressure to 40% of the expected fracture pressure of the rock formation from 60% of the expected fracture pressure of the rock formation.

Aspects of the example wellbore fracturing method, which can be combined with the example wellbore fracturing method alone or with other aspects, include the following. Cycling the pressure includes increasing the pressure to 70% of the expected fracture pressure of the rock formation, and decreasing the pressure to 40% of the expected fracture pressure of the rock formation from 70% of the expected fracture pressure of the rock formation.

Aspects of the example wellbore fracturing method, which can be combined with the example wellbore fracturing method alone or with other aspects, include the following. Cycling the pressure includes increasing the pressure to 80% of the expected fracture pressure of the rock formation, and decreasing the pressure to 40% of the expected fracture pressure of the rock formation from 80% of the expected fracture pressure of the rock formation.

Aspects of the example wellbore fracturing method, which can be combined with the example wellbore fracturing method alone or with other aspects, include the following. Cycling the pressure includes increasing the pressure to 85% of the expected fracture pressure of the rock formation, and decreasing the pressure to 40% of the expected fracture pressure of the rock formation from 85% of the expected fracture pressure of the rock formation.

Particular implementations of the subject matter described in this disclosure can be implemented so as to realize one or more of the following advantages. The concepts described herein can allow fracturing at sites with lower horsepower available than would otherwise be necessary to successfully fracture geologic formations within a wellbore. Another advantage of the disclosure is it provides a unique injection technique to introduce hydraulic fractures in the geologic formation without any change or addition of hardware or equipment.

The details of one or more implementations of the subject matter described in this disclosure are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Traditional fracturing techniques require high pressures and flow rates to initiate fracturing within a wellbore. Such a combination of high pressure and flow typically requires a large amount of power. So much power is needed that specialized fracturing skids, trucks, or boats are often needed solely to provide sufficient power for fracturing. Such equipment is in limited supply and can easily be delayed, causing delays in fracturing operations for wellsites that need such interventions.

This disclosure describes a method that can be utilized with less available power than what is required for a typical fracturing technique. The method includes cycling pressure within a target zone of a wellbore such that the predicted fracturing pressure is never reached. Instead, a pressure is maintained at a specified, lower threshold (for example, 40% of the expected fracture pressure), and is cycled between the lower threshold and an upper threshold (for example 85% of the expected fracturing pressure). In some instances, different upper thresholds can be used. In instances where the expected fracturing pressure is unknown, the maximum pressure attainable by the power available at a fracturing site can be considered the expected fracturing pressure for the purposes of the methods described herein.

Figure 1:
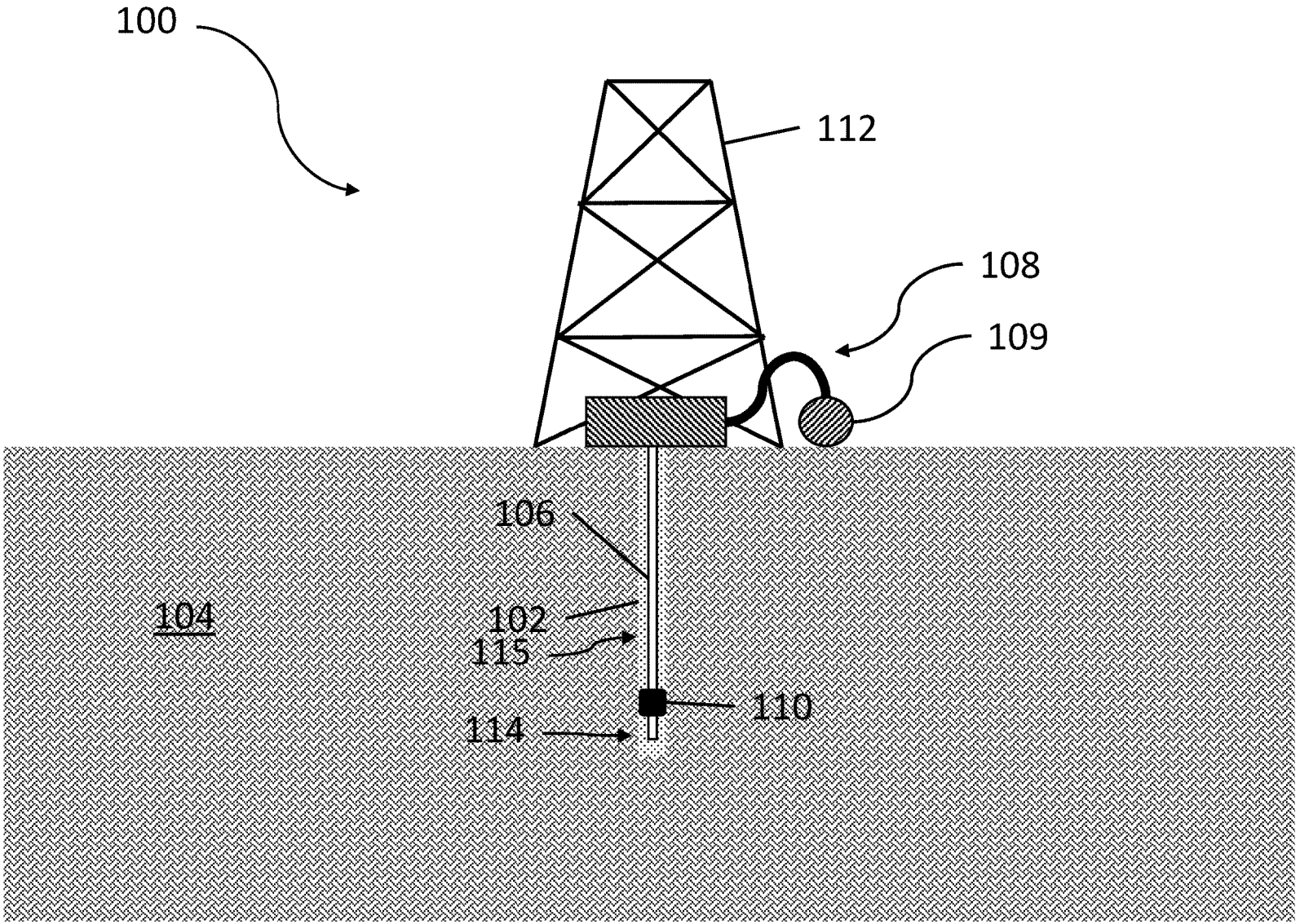
FIG. 1 is a schematic diagram of an example wellsite.

FIG. 1 is a schematic diagram of an example wellsite 100. The wellsite 100 includes a wellbore 102 formed within a geologic rock formation 104. A workstring 106 extends from a topside facility 108 into the wellbore 102. Near a downhole end of the workstring 106 is a packer 110 that provides an annular seal between a targeted zone 114 of the wellbore 102 and a remainder 115 of the wellbore 102. In some implementations, the workstring 106 can be supported by a derrick 112.

The topside facility 108 can include pumps 109, separators, shaker tables, and other equipment used for drilling, fracturing, production operations, or a combination. Regarding fracturing operations, the pumps 109 included at the topside facility 108 are arranged to pump fracturing fluid down the workstring 106 to the target zone 114. Such pumps 109 can include standard triplex plunger pumps or other pumps suitable for such an operation. The pumps 109 are used to regulate fluid pressure within the target zone 114. For example, the pumps 109 can be used to increase fluid pressure within the target zone 114. In some implementations, additional valving can be included to reduce a pressure within the target zone 114. In some implementations, such valving is already included within the pumping systems available at the topside facility 108.

The workstring 106 can include drill piping, coiled tubing, production tubing, or any suitable tubular for the desired operation. While illustrated as being supported by the derrick 112, other systems can be used without departing from this disclosure. For example, standard tubing hangers can be used, such as when the workstring 106 includes production tubing. In some implementations, a coiled tubing truck and lubricator can be used, such as when the workstring 106 includes coiled tubing. While illustrated as using a single packer 110, multiple packers isolating one or more target zones can be used without departing from this disclosure. While the wellbore 102 is illustrated as a vertical wellbore, aspects of this disclosure are applicable to horizontal and deviated wellbores as well.

Figure 2:
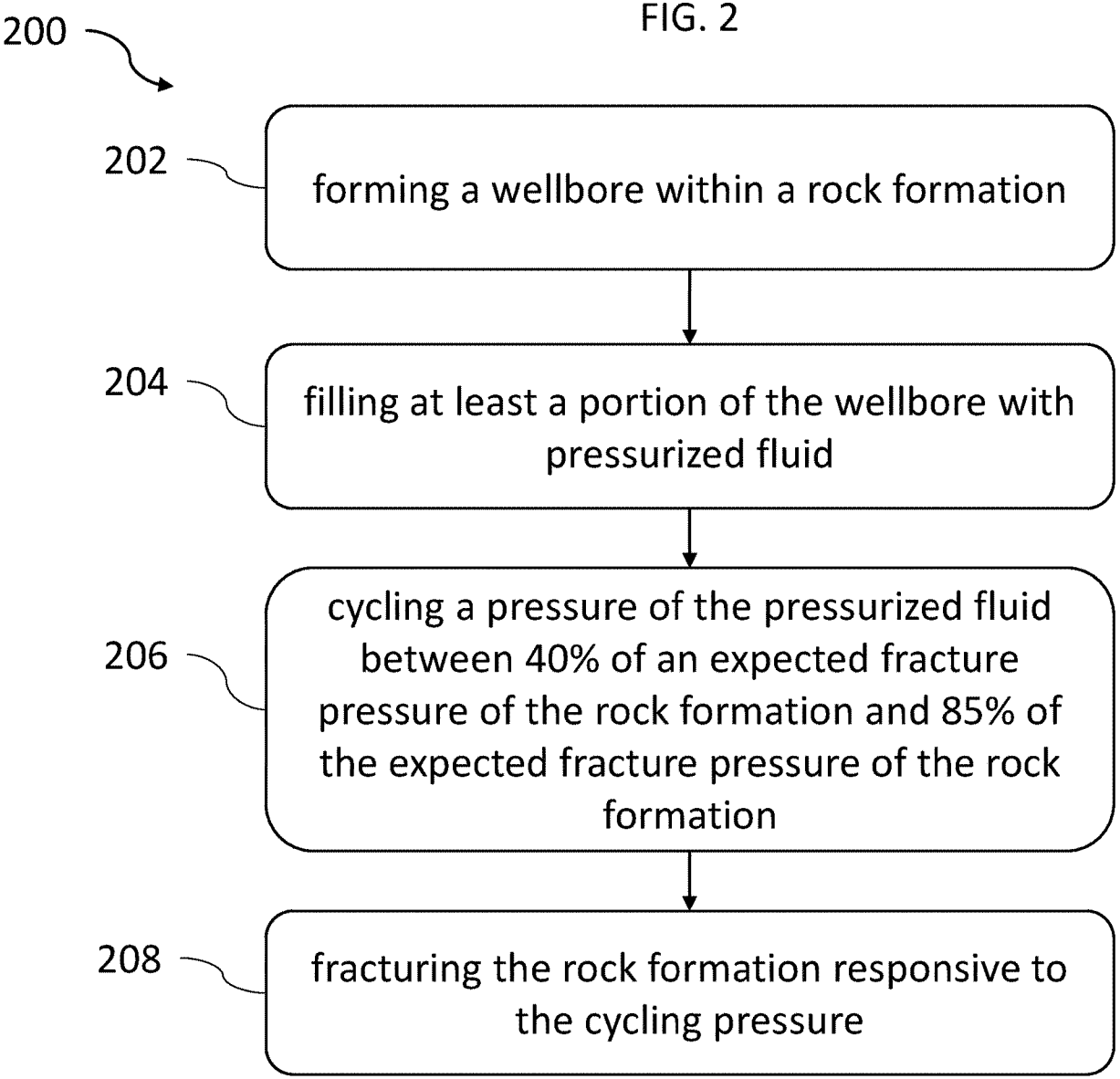
FIG. 2 is a flowchart of an example method that can be used with aspects of this disclosure.

FIG. 2 is a flowchart of an example method 200 that can be used with aspects of this disclosure. At 202, a wellbore is formed within a rock formation. At 204, at least a portion of the wellbore is filled with pressurized fluid, for example, the target zone 114. The target zone 114 can be filled with a pressurized fluid by the workstring 106, which is supplied by pumps 109 at the topside facility 108.

At 206, a pressure of the pressurized fluid is cycled between 40% of an expected fracture pressure of the rock formation and 85% of the expected fracture pressure of the rock formation. Examples of such cycling are described throughout this disclosure. In general, during the cycling process, the pressure does not reduce to less than a set lower limit, for example, 40% of the predicted fracture pressure. Similarly, the peak pressure of the cycle does not exceed the predicted fracture pressure, and can even include a margin of safety, for example, the pressure may not exceed 85% of the predicted fracture pressure. In some implementations, the predicted fracture pressure can be determined based on rock samples acquired during the drilling process. In instances where the predicted fracture pressure is not available, or in instances where the pumping power at the topside facility is limited, 100% available pumping power can be used in lieu of the predicted fracture pressure. Throughout this disclosure, predicted fracture pressure can also be interpreted as available pumping power depending upon the situation. In general, cycling the pressure typically includes flowing, by the topside pumps 109, the pressurized fluid until a first target pressure is reached. After the first target pressure is reached, pressure on the fluid is released until a second target pressure is reached. The second target pressure is less than the first target pressure. Relieving the pressure can involve opening a valving system to safely relieve the pressure, or it can include using the topside pumps 109 to flow fluid from the target zone 114.

At 208, the rock formation is fractured responsive to the cycling pressure. This occurs despite not increasing the fluid pressure to the predicted fracture pressure as the cycling pressure weakens the rock without the need for such high pressures to be produced.

Figure 3:
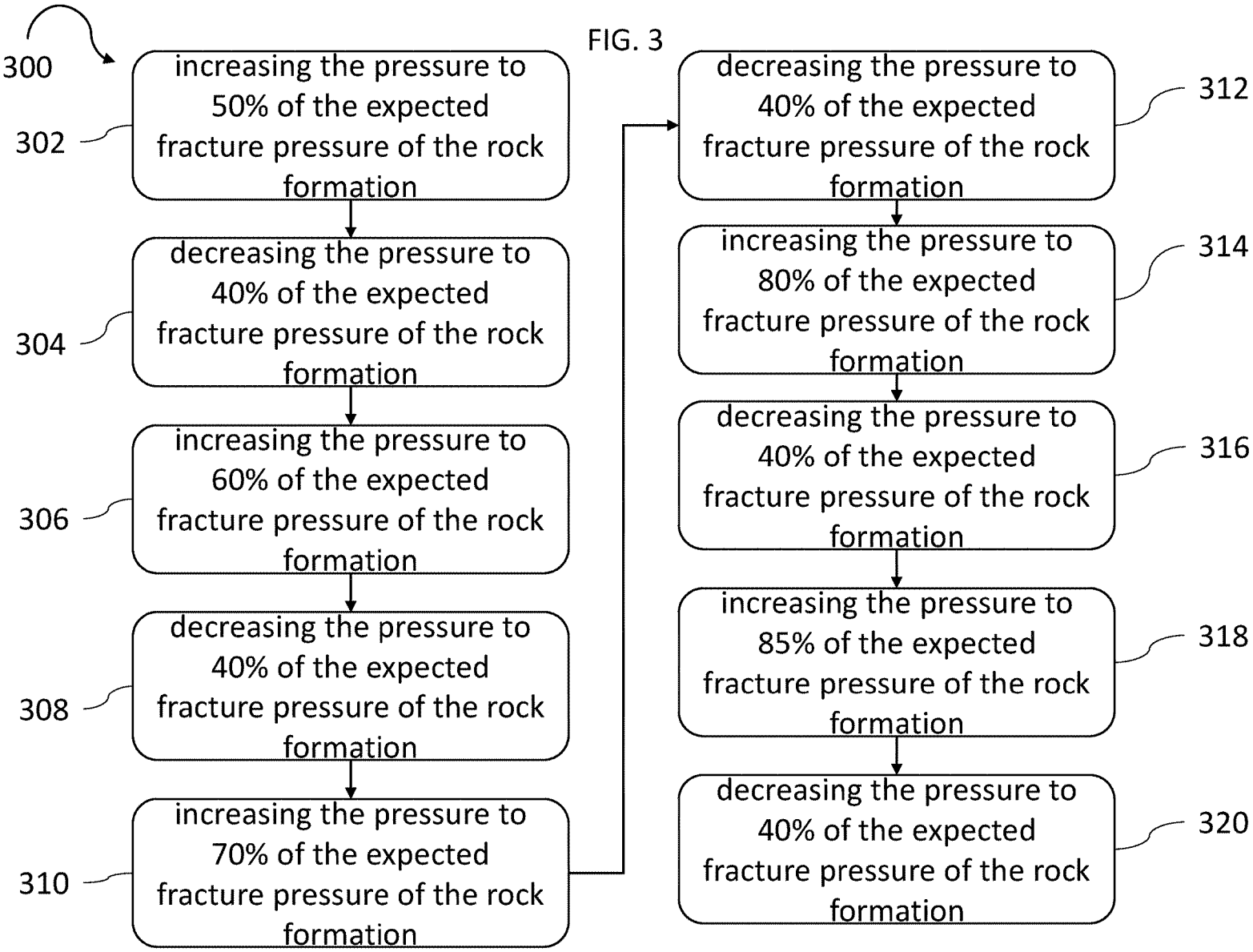
FIG. 3 is a flowchart of an example method that can be used with aspects of this disclosure.

FIG. 3 is a flowchart of an example method 300 that can be used with aspects of this disclosure. More specifically, method 300 is an example of steps that can be taken to cycle the pressure. The method 300 is just an example cycling method, and other cycling methods can be used without departing from this disclosure so long as such methods do not reach the expected fracturing pressure or 100% available pumping power, and so long as they do not allow the pressure to drop below a certain threshold, such as 40%, of the expected fracturing pressure or available pumping power.

At 302, the pressure within the target zone is increased to 50% of the expected fracture pressure of the rock formation 104. At 304, the pressure within the target formation is decreased to 40% of the expected fracture pressure of the rock formation. It should be noted that in this example, the pressure never drops below substantially 40% of the expected fracture pressure (within standard operational deviations).

At, 306, the pressure within the target zone is increased from 40% of the expected fracture pressure of the rock formation to 60% of the expected fracture pressure of the rock formation. At 308, the pressure within the target zone is decreased to 40% of the expected fracture pressure of the rock formation from 60% of the expected fracture pressure of the rock formation.

At 310, the pressure within the target zone is increased from 40% of the expected fracture pressure of the rock formation to 70% of the expected fracture pressure of the rock formation. At 312, the pressure within the target zone is decreased to 40% of the expected fracture pressure of the rock formation from 70% of the expected fracture pressure of the rock formation.

At 314, the pressure within the target zone is increased from 40% of the expected fracture pressure of the rock formation to 80% of the expected fracture pressure of the rock formation. At 316, the pressure within the target zone is decreased to 40% of the expected fracture pressure of the rock formation from 80% of the expected fracture pressure of the rock formation.

At 318, the pressure the pressure within the target formation is increased from 40% of the expected fracture pressure of the rock formation to 85% of the expected fracture pressure of the rock formation. At 320, the pressure within the target zone is decreased to 40% of the expected fracture pressure of the rock formation from 85% of the expected fracture pressure of the rock formation.

In some instances, the rock may fracture prior to the example method 300 being completed. In such instances, the method can be stopped upon fracturing of the geologic formation. In some instances, the rock formation may not have fractured after completing method 300. In such instances, the method 300 can be repeated until fracturing occurs.

While this disclosure contains many specific implementation details, these should not be construed as limitations on the scope of what may be claimed, but rather as descriptions of features specific to particular implementations. Certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. Moreover, the separation of various system components in the implementations described above should not be understood as requiring such separation in all implementations, and it should be understood that the described components and systems can generally be integrated together in a single product or packaged into multiple products.

Thus, particular implementations of the subject matter have been described. Other implementations are within the scope of the following claims. In some cases, the actions recited in the claims can be performed in a different order and still achieve desirable results. In addition, the processes depicted in the accompanying figures do not necessarily require the particular order shown, or sequential order, to achieve desirable results.

What is claimed is:

1. A method of fracturing a wellbore within a rock formation, the method comprising:

deploying a packer along the wellbore to isolate a target zone of the wellbore located downhole of the packer;

cycling a pressure of fracturing fluid within the target zone by:

pumping fracturing fluid into the target zone until the pressure reaches a target pressure, relieving the pressure until the pressure falls from the target pressure to a minimum cycling pressure below which the pressure is not cycled, pumping fracturing fluid into the target zone until the pressure increases from the minimum cycling pressure to a maximum cycling pressure above which the pressure is not cycled, the maximum cycling pressure being greater than the target pressure and less than an expected fracture pressure of the wellbore, and relieving the pressure until the pressure falls from the maximum cycling pressure to the minimum cycling pressure; and fracturing the rock formation along the target zone of the wellbore in response to cycling the pressure of fracturing fluid within the target zone.

2. The method of claim 1, wherein the minimum cycling pressure is 40% of the expected cycling pressure.

3. The method of claim 2, wherein the maximum cycling pressure is 85% of the expected cycling pressure.

4. The method of claim 3, wherein the pressure of fracturing fluid within the target zone remains between 40% and 85% throughout cycling of the pressure.

5. The method of claim 4, wherein the rock formation is fractured in response to cycling the pressure without the pressure reaching the expected cycling pressure.

6. The method of claim 5, further comprising conserving power that would otherwise be expended in increasing the pressure of the fracturing fluid to the expected cycling pressure to fracture the rock formation along the target zone.

7. The method of claim 5, wherein cycling the pressure of fracturing fluid within the target zone further comprises:

pumping fracturing fluid into the target zone until the pressure increases from the minimum cycling pressure to a second target pressure that is greater than the first target pressure, and relieving the pressure until the pressure falls from the second target pressure to the minimum cycling pressure.

8. The method of claim 7, wherein the first target pressure is 50% of the expected cycling pressure.

9. The method of claim 8, wherein the second target pressure is 60% of the expected cycling pressure.

10. The method of claim 9, wherein cycling the pressure of fracturing fluid within the target zone further comprises:

pumping fracturing fluid into the target zone until the pressure increases from the minimum cycling pressure to a third target pressure that is greater than the second target pressure and less than the maximum cycling pressure, and relieving the pressure until the pressure falls from the third target pressure to the minimum cycling pressure.

11. The method of claim 10, wherein the third target pressure is 70% of the expected cycling pressure.

12. The method of claim 11, wherein cycling the pressure of fracturing fluid within the target zone further comprises:

pumping fracturing fluid into the target zone until the pressure increases from the minimum cycling pressure to a fourth target pressure that is greater than the third target pressure and less than the maximum cycling pressure; and relieving the pressure until the pressure falls from the fourth target pressure to the minimum cycling pressure.

13. The method of claim 12, wherein the fourth target pressure is 80% of the expected cycling pressure.

14. The method of claim 7, wherein a difference between the second target pressure and the first target pressure is a 10% multiple of the expected cycling pressure.

15. The method of claim 1, wherein cycling the pressure of fracturing fluid within the target zone comprises a pressure cycle, and wherein the method further comprises repeating the pressure cycle one or more times before the rock formation fractures along the target zone.

16. The method of claim 1, further comprising determining the expected fracture pressure based on an analysis of rock samples acquired from the rock formation prior to cycling the pressure of fracturing fluid.

17. The method of claim 1, further comprising determining the expected fracture pressure to be 100% of an available pumping power present at the wellbore.

18. The method of claim 1, wherein relieving the pressure comprises opening a valving system associated with the wellbore.

19. The method of claim 1, wherein relieving the pressure comprises pumping fracturing fluid away from the target zone.

20. The method of claim 1, wherein pumping fracturing fluid into the target zone comprises filling the target zone with fracturing fluid.

* * * * *